US005731023A

United States Patent [19]

Milani

[11] Patent Number: 5,731,023

[45] Date of Patent: Mar. 24, 1998

[54] METHOD FOR PACKAGING CARBON DIOXIDE ABSORBING FOOD PRODUCTS

[75] Inventor: Marco Milani, Lecco, Italy

[73] Assignee: Valle Spluga S.p.A., Gordona, Italy

[21] Appl. No.: 173,260

[22] Filed: Dec. 27, 1993

Related U.S. Application Data

[63] Continuation-in-part of Ser. No. 724,510, Jun. 28, 1991, abandoned, which is a continuation of Ser. No. 429,596, Oct. 31, 1989, abandoned.

[30] Foreign Application Priority Data

| | | | |
|---|---|---|---|
| Nov. 8, 1988 | [IT] | Italy | 22543/88 |
| May 3, 1989 | [IT] | Italy | 20353/89 |

[51] Int. Cl.[6] ..... B65B 31/00; A23L 3/3418

[52] U.S. Cl. ..... 426/410; 426/413; 426/418; 426/129; 53/434

[58] Field of Search ..... 426/129, 130, 426/109, 418, 419, 410, 392, 393, 397, 413; 53/432, 433, 434

[56] References Cited

U.S. PATENT DOCUMENTS

| | | | |
|---|---|---|---|
| 2,027,429 | 1/1936 | Hansen | 426/418 |
| 2,159,835 | 5/1939 | Waters | 426/124 |
| 2,391,354 | 12/1945 | Slosberg | 426/87 |
| 2,541,441 | 2/1951 | Sharp et al. | 426/418 |
| 2,623,826 | 12/1952 | Grinstead | 426/129 |
| 2,753,268 | 7/1956 | Ingle | 426/130 |
| 2,838,403 | 6/1958 | Notter . | |
| 2,955,045 | 10/1960 | Coffey et al. | 426/130 |
| 2,967,777 | 1/1961 | Grindrod | 426/130 |
| 3,393,077 | 7/1968 | Moreau | 426/410 |
| 3,498,799 | 3/1970 | Geyer | 426/109 |
| 3,574,642 | 4/1971 | Weinke | 426/129 |
| 3,627,393 | 12/1971 | Hickson et al. | 426/124 |
| 3,659,393 | 5/1972 | Richter . | |
| 3,681,092 | 8/1972 | Titchenal et al. | 426/124 |
| 3,987,209 | 10/1976 | Gatineau | 426/396 |
| 4,055,672 | 10/1977 | Hirsch et al. | 426/129 |
| 4,485,854 | 12/1984 | Roullet | 53/432 |
| 4,588,000 | 5/1986 | Malin et al. | 53/432 |
| 4,594,253 | 6/1986 | Fradin | 426/418 |
| 4,653,643 | 3/1987 | Black | 206/528 |
| 4,703,609 | 11/1987 | Yoshida et al. | 53/432 |
| 4,805,768 | 2/1989 | Nishiguchi et al. | 426/87 |
| 4,869,047 | 9/1989 | Nishiguchi et al. | 53/432 |
| 4,947,650 | 8/1990 | Blanton | 53/432 |

FOREIGN PATENT DOCUMENTS

| | | | |
|---|---|---|---|
| 727465 | 2/1966 | Canada | 53/432 |
| 207637 | 1/1987 | European Pat. Off. | 426/129 |
| 3702807 | 8/1988 | Germany . | |
| 178900 | 8/1983 | Hungary . | |

OTHER PUBLICATIONS

Refrigerating Engineering May 1949 p. 453.
J. Agric Food Chem. vol. 23 No. 6 1975 p. 1208.
Modern Packaging Oct. 1969 p. 183.
Broiler Industry Jun. 1976 p. 14.
Nat'l Provisioner Jan. 31, 1959 p. 7.
Dr. György Beke "The Handbook of Cooling"(Hütöiparikézikönyv) (no date given) pp. 64–65.
"Reducing package deformation an increasing filling degree in Packages of Cod filters in $CO_2$–enriched atmospheres by adding Sochium Carbonate aud Citric Acid to an Oxudote Absorber" by Bjerkeno, Siverstrik, Rosues, aud Bergslien, presented at the Symposium on Interactions Food and Food Packaging, Luud Sweden, Jun. 10, 1984. Symposium on Interactions Food and Food Packaging, Lund, Sweden Jun. 10, 1994.

*Primary Examiner*—Steven Weinstein
*Attorney, Agent, or Firm*—Guido Modiano; Albert Josif

[57] ABSTRACT

A method for packaging products susceptible of absorbing carbon dioxide, in particular perishable food products. The method comprises the step of inserting a product in a containment package and the step of sealing the package. Before sealing, a preset amount of solid-phase carbon dioxide is introduced in the containment package. The sublimated carbon dioxide is then absorbed by the packaged product, avoiding collapse of the package.

10 Claims, 1 Drawing Sheet

METHOD FOR PACKAGING CARBON DIOXIDE ABSORBING FOOD PRODUCTS

This is a continuation-in-part of application Ser. No. 724,510 filed on Jun. 28, 1991, now abandoned; which in turn is a continuation of Ser. No. 429,596 filed on Oct. 31, 1989, now abandoned.

BACKGROUND OF THE INVENTION

The present invention relates to a method and an apparatus for packaging products absorbing carbon dioxide, in particular perishable food products.

As is known, in order to improve the preservability or shelf life of perishable food products, in particular meat products, which have the ability to absorb carbon dioxide, such products are packaged with adapted devices which alter or completely replace the atmosphere inside the product containment package before it is finally sealed by introducing therein gaseous-phase carbon dioxide or a mixture of gases composed also of carbon dioxide. These packaging methods of altering the atmosphere inside the product containment package are commonly referred to as controlled or modified atmosphere packaging. Alteration of the gaseous atmosphere includes reduction of oxygen and increase of carbon dioxide, independently or together, but preferably together, to generate a synergistic effect. Initial alteration of the atmosphere is generally accomplished by removing the bulk of the air by vacuum and then replacing it with a gas mixture of carbon dioxide and nitrogen, and sometimes oxygen. After the atmosphere is modified, sealing of the package takes place and the product begins to absorb the carbon dioxide.

The progressive absorption of carbon dioxide on the part of the product acidifies it, entailing a significant improvement to its shelf life.

Said progressive absorption of carbon dioxide also causes a reduction of the carbon dioxide in the space surrounding the product, consequently producing a vacuum inside the package with the disadvantage of an inward collapse of the package if it is made of easily deformable material, as is usually the case for synthetic-material packaging containers. In particular, carbon dioxide is soluble in the water or fat tissue and so gaseous carbon is absorbed into the food product so that the partial pressure of the gas in the surrounding space is reduced creating a partial vacuum which distorts or deforms the containment package which can crush the products.

In the case of products capable of absorbing large amounts of carbon dioxide, such as for example meat products, the collapse of the package can cause the crushing of the products contained therein, deforming them and in some cases squeezing liquids out of them which make the appearance of said products extremely unappealing. The squeezing of liquids is also undesirable in that the purge or liquid is a better microbiological growth medium than is the tissue itself. Thus, the presence of purge can detract from the shelf-life extension.

In view of the fact that these packaging methods are predominantly used for food products, the problem of the vacuum which forms inside the package, with the consequent deformation thereof, is strongly felt in the field, since very often it compromises the salability of the product.

The absorption of carbon dioxide by the product furthermore modifies the percentages of gas, reducing the free carbon dioxide in the atmosphere inside the container and limiting the potential shelf life of the product.

The deformation of the packaging container, besides causing problems related to the appearance of the product, may furthermore cause the customer information, such as for example the date before which the product is to be eaten or other indications which are usually printed directly on the package or on sheets glued to the package or inserted therein, to become partially or totally unreadable.

SUMMARY OF THE INVENTION

The aim of the present invention is to solve the above described problems by providing a method for packaging products susceptible of absorbing carbon dioxide, in particular perishable food products, which avoids or at least considerably reduces the deformation of the package caused by vacuum after packaging.

Within the scope of the above described aim, an object of the invention is to provide a method which improves the shelf life of products susceptible of absorbing carbon dioxide and respects the integrity of the product during packaging.

Another object of the invention is to provide a method which does not contaminate the product with health-damaging substances.

This aim, as well as these and other objects which will become apparent hereinafter, are achieved by a method for packaging products susceptible of absorbing carbon dioxide, in particular perishable food products, as defined in claim 1. In particular, according to the invention, there is provided a method for preventing the inwardly collapsing deformation of a flexible containment package in which is packed a product capable of absorbing carbon dioxide, which method comprises the step of introducing together into the containment package:

the product;

a gaseous environment which includes a carbon dioxide gas and which is advantageously at atmospheric pressure; and an amount of solid-phase carbon dioxide which is preset according to the amount of carbon dioxide which can be absorbed by the product after packaging.

After these elements are introduced together into the containment package, such containment package is sealed. The solid-phase carbon dioxide is subsequently left to sublimate and the product absorbs carbon dioxide until an equilibrium condition is reached. When the amount of solid-phase carbon dioxide introduced into the containment package is substantially equal to the exact amount which can be absorbed by the product, according to the conditions dependent upon the make-up of the modified atmosphere introduced initially, then the containment package will essentially have a shape which is equivalent to its original shape at the time of sealing. Alternatively, a slightly larger amount of solid-phase carbon dioxide can be added at these conditions and then the package will have a slightly "puffed" appearance in the equilibrium state. The method according to the invention can thus be defined as a "two-phase" method which uses simultaneously modified atmosphere with a gaseous carbon dioxide component together with the solid-phase carbon dioxide component. The problem of package collapse on the product is thus eliminated with the method according to the invention, and such method is advantageously applicable on an industrial scale thanks to its extreme simplicity and practicability. At the same time that package collapse is avoided, the shelf-life of the product is greatly extended, since high concentrations of carbon dioxide gas surrounding the product in the equilibrium state can be maintained, due to the fact that the solid-phase carbon dioxide compensates for the amount of carbon dioxide which is absorbed. It can be thought of therefore that the product, in a sense, absorbs the carbon dioxide from the solid-phase, while leaving alone the carbon dioxide gas in the introduced modified atmosphere, even though during the course of carbon dioxide absorption the product may absorb the gas from the modified atmosphere.

BRIEF DESCRIPTION OF THE DRAWINGS

The characteristics and advantages of the invention will become apparent from the description of a preferred but not exclusive embodiment of the method according to the invention, illustrated only by way of non-limitative example in the accompanying drawings, wherein.

DESCRIPTION OF THE PREFERRED EMBODIMENTS

Figures 1, 2, 3, 4, 5, 6:
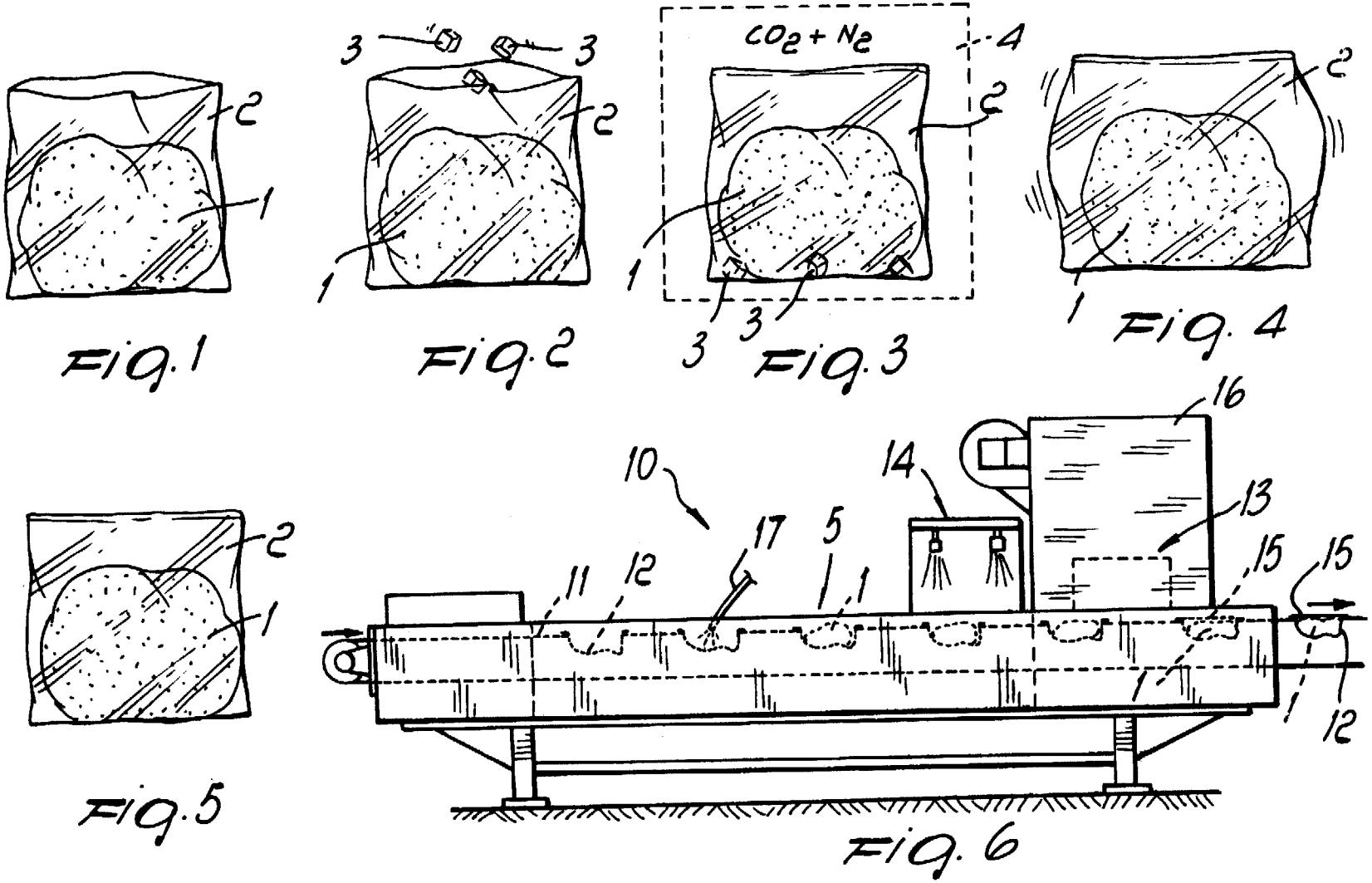
FIGS. 1 to 5 illustrate in sequence the various steps of the packaging method according to the invention.
FIG. 6 is a schematic lateral elevation view of a packaging apparatus for automatically performing the method according to the invention.

With reference in particular to FIGS. 1 to 5, the method according to the invention comprises a first step wherein a product 1 or a plurality of products is inserted into a known containment package 2 made for example of synthetic material (FIG. 1), and a second step in which a preset amount of solid-phase carbon dioxide is introduced inside the package 2 (FIG. 2).

The package 2 is subsequently sealed, for example by heat-welding, glueing or by other known sealing methods, so as to isolate the inside of the package from the atmospheric environment.

The introduction of solid-phase carbon dioxide into the package 2 may naturally precede or follow the insertion of the product 1 or be simultaneous therewith.

The amount of carbon dioxide to be introduced in the package 2 is preset according to the amount of carbon dioxide which can be absorbed by the product after packaging, taking also into account the mechanical resistance of the package 2 and the final result to be obtained, for example so as to avoid the collapse of the package 2 even several days after packaging.

The amount of solid-phase carbon dioxide to be introduced in the package 2 may be easily determined on the basis of studies of the absorption in the various products, since it has been found that most of the products susceptible of absorbing carbon dioxide absorb most of the potentially absorbable carbon dioxide within a few hours after packaging, reaching a condition of equilibrium.

The solid-phase carbon dioxide is introduced into the package 2 in the form of cubes or tablets 3 of dry ice with a preset weight so as to meet the absorbability requirements of the product as described above.

As an alternative, the solid-phase carbon dioxide may also be introduced in the package 2 in the form of finely flaked dry ice ("carbonic snow").

Advantageously, before sealing, it is possible to "wash" the inside of the package 2 by means of a jet of inert gas, for example nitrogen, which at least partially replaces the air inside the package 2.

If required, the air present in the package 2 may be replaced completely with a controlled atmosphere constituted for example by a mixture of gas which predominantly contains carbon dioxide and nitrogen, sealing the package in an appropriate chamber 4 with a controlled atmosphere, as occurs in known packaging methods indeed termed "controlled-atmosphere packaging methods".

After sealing, the solid-phase carbon dioxide introduced in the package 2 slowly sublimates, pressurizing the interior of the package, while the product starts to absorb the gaseous-phase carbon dioxide, progressively decreasing the overpressure which has formed inside the package 2 (FIG. 4). A few hours after packaging, the pressure inside the package 2 stabilizes and the package 2 assumes a configuration which remains substantially unchanged for several days after packaging (FIG. 5). For example, if the amount of solid-phase carbon dioxide introduced in the package 2 together with the amount of gas-phase carbon dioxide possibly introduced when replacing the atmosphere inside the package 2 (if replacement is provided for) is slightly larger than the amount of carbon dioxide required to make the product reach the equilibrium condition, a mixture of gases, including carbon dioxide, with a slight overpressure or at ambient pressure is present inside the package 2 even several days after packaging, so as to avoid collapse even with packages which have an extremely low mechanical resistance or do not have an own form, such as soft bags.

It should be noted that with the method according to the invention, if a complete replacement of the atmosphere inside the package 2 is not required, both the step of introducing solid-phase carbon dioxide inside the package and the subsequent step of sealing the package 2 may occur in an atmospheric environment, since for a wide range of products correct preservation is in any case ensured by the modification of the atmosphere inside the package 2 caused by the sublimation of the solid-phase carbon dioxide.

While the method according to the invention may be carried out in a simple manner even by a sequence of manual operations, by virtue of its simplicity, an apparatus generally indicated by the reference numeral 10 in FIG. 6 may be used; said apparatus comprises a known packaging system with a conveyor element 11 on which the preformed packages 12 intended to contain the products 1 are placed. Said conveyor element 11 is movable along a path which traverses in sequence a station 5 for inserting the products 1 in the packages 12 and a sealing station 13 in which the packages 12 are closed by means of known devices. According to the invention, a dispenser device 14 is arranged ahead of the sealing station 13 according to the direction of advancement of the conveyor element; said device introduces a preset amount of solid-phase carbon dioxide into the packages 12 and may be simply constituted, as illustrated, by nozzles which are fed by a known system and dispense a preset amount of finely flaked dry ice onto the product inside the package which is located in that moment below said nozzles.

According to another embodiment, not illustrated for the sake of simplicity, the dispenser device may also be constituted by a means for dispensing dry ice tablets which are introduced, like the finely flaked dry ice, in the packages 12.

The sealing station 13 may be simply constituted by a known device which closes the open side of the packages 12 for example by heat-welding thereon a sheet of synthetic material 15.

If it is necessary to replace the atmosphere inside the packages 12, the sealing station 13 may be placed inside a controlled-atmosphere chamber 16 which contains, in a known manner, a mixture of gases, for example a mixture of carbon dioxide and nitrogen, as in known controlled-atmosphere packaging devices.

If complete replacement of the atmosphere inside the packages 12 is not required, a partial replacement of the atmosphere inside the packages 12 may be provided by arranging a dispenser 17 of inert gas, for example nitrogen, ahead of the solid-phase carbon dioxide dispensing device 14. Said dispenser 17 may be simply constituted by a duct which feeds a jet of inert gas inside the packages 12.

In practice it has been observed that the method according to the invention fully achieves the intended aim, since by virtue of the introduction of solid-phase carbon dioxide the amount of carbon dioxide which is absorbed by the product after packaging is compensated and therefore in practice vacuum does not form inside the package or in any case it can be kept within such limits as not to modify the original shape of the package to a significant extent.

A further advantage, in view of the simple execution of the method according to the invention, is the fact that it can be used in both manual packaging methods and in automated packaging methods.

Though the method according to the invention has been conceived in particular for the packaging and preservation of perishable food products, it may in any case be used successfully also for any kind of product susceptible of absorbing carbon dioxide with similar problems regarding the integrity of the package and of the product after packaging.

The method thus conceived is susceptible to numerous modifications and variations, all of which are within the scope of the inventive concept; all the details may furthermore be replaced with technically equivalent elements.

I claim:

1. A method for preventing the inwardly collapsing deformation of a flexible package in which is packed a perishable, moisture containing food product capable of absorbing carbon dioxide, comprising the steps of:

introducing the product into the package;

providing: both an initial gaseous environment in the package, said initial gaseous environment comprising carbon dioxide gas and being at substantially atmospheric pressure; and an amount of solid-phase carbon dioxide inside the package, the amount of solid-phase carbon dioxide being preset according to the amount of carbon dioxide which can be absorbed by the product after packaging;

heat sealing the package having the product and both the solid-phase carbon dioxide and the initial gaseous environment contained therein, the pressure of said initial gaseous environment defining an original shape of the package in a sealed state which original shape does not cause the package to crush or deform the product or squeeze liquid from the product therein;

and then leaving both the solid-phase carbon dioxide to sublimate and the product to absorb carbon dioxide in the sealed package, the pressure of carbon dioxide gas in the initial gaseous environment and the amount of solid phase carbon dioxide initially present in the package combining to both provide sufficient carbon dioxide to be absorbed by said perishable food product to acidify the food product to increase the shelf life of the food product and such that at a final carbon dioxide equilibrium condition of carbon dioxide between carbon dioxide absorbed by the food product and carbon dioxide gas between the food product and the package, sufficient carbon dioxide gas remains between the food product and the package such that the final shape of the package being essentially equivalent to the original shape of said package.

2. The method of claim 1, wherein the initial gaseous environment is essentially constituted by a mixture of carbon dioxide and nitrogen gases.

3. The method of claim 2, wherein the mixture is made of fifty percent carbon dioxide gas and fifty percent nitrogen gas.

4. The method of claim 1, wherein the product is a meat product.

5. The method of claim 1, wherein the product is a chicken product.

6. A method for preventing the inwardly collapsing deformation of a flexible package in which is packed a perishable, moisture containing food product capable of absorbing carbon dioxide, comprising the steps of:

introducing the product into the package;

providing: both an initial gaseous environment in the package, said initial gaseous environment comprising carbon dioxide gas; and an amount of solid-phase carbon dioxide inside the package, the amount of solid-phase carbon dioxide being preset according to the amount of carbon dioxide which can be absorbed by the product after packaging;

heat sealing the package having the product and both the solid-phase carbon dioxide and the initial gaseous environment contained therein, the pressure of said initial gaseous environment defining an original shape of the package in a sealed state which original shape does not cause the package to crush or deform the product or squeeze liquid from the product therein;

and then leaving both the solid-phase carbon dioxide to sublimate and the product to absorb carbon dioxide in the sealed package, the pressure of carbon dioxide gas in the initial gaseous environment and the amount of solid phase carbon dioxide initially present in the package combining to both provide sufficient carbon dioxide to be absorbed by said perishable food product to acidify the food product to increase the shelf life of the food product and such that at a final carbon dioxide equilibrium condition of carbon dioxide between carbon dioxide absorbed by the food product and carbon dioxide gas between the food product and the package, sufficient carbon dioxide gas remains between the food product and the package such that the final shape of the package being essentially equivalent to the original shape of said package.

7. The method of claim 6, wherein said initial gaseous environment is at substantially atmospheric pressure.

8. The method of claim 6, wherein said initial gaseous environment is essentially constituted by a mixture of carbon dioxide and nitrogen gases.

9. The method of claim 8, wherein the mixture is made of fifty percent carbon dioxide gas and fifty percent nitrogen gas.

10. The method of claim 8, wherein said initial gaseous environment is at substantially atmospheric pressure.

* * * * *